US007037035B2

(12) United States Patent
Casters

(10) Patent No.: US 7,037,035 B2
(45) Date of Patent: May 2, 2006

(54) METHOD AND MACHINE FOR FORMING A CONCRETE PATH OR THE LIKE, AS WELL AS DEVICE FOR INSERTING DOWELS APPLIED HEREWITH

(75) Inventor: Francois Joseph Casters, Opglabbeek (BE)

(73) Assignee: Drion Constructie, Opglabbeek (BE)

( * ) Notice: Subject to any disclaimer, the term of this patent is extended or adjusted under 35 U.S.C. 154(b) by 235 days.

(21) Appl. No.: 10/216,848

(22) Filed: Aug. 13, 2002

(65) Prior Publication Data

US 2003/0041556 A1 Mar. 6, 2003

(30) Foreign Application Priority Data

Aug. 13, 2001 (BE) ..... 2001/0543

(51) Int. Cl.
*E01C 23/04* (2006.01)

(52) U.S. Cl. ..... 404/88; 404/100

(58) Field of Classification Search ..... 404/88, 404/84.05, 84.1–84.5, 100
See application file for complete search history.

(56) References Cited

U.S. PATENT DOCUMENTS 3,274,906 A * 9/1966 Worson et al. ..... 404/87
3,849,016 A * 11/1974 Cochrane et al. ..... 404/100
4,312,602 A * 1/1982 Dale ..... 404/100
4,493,584 A * 1/1985 Guntert ..... 404/74
4,636,110 A * 1/1987 Augoyard ..... 404/100
5,209,602 A * 5/1993 Godbersen ..... 404/88
5,405,242 A * 4/1995 Auxier et al. ..... 415/115
5,588,776 A * 12/1996 Swisher et al. ..... 404/72
6,390,727 B1 * 5/2002 Guntert et al. ..... 404/88
6,481,923 B1 * 11/2002 Casters ..... 404/104

FOREIGN PATENT DOCUMENTS

EP 0 518 535 A1 12/1992
FR 2 164 580 11/1972
GB 1415308 * 10/1972

OTHER PUBLICATIONS

Concrete roads-Development of new techniques; *Highways and Road Construction*, Jun. 1973, p. 13.

* cited by examiner

*Primary Examiner*—Raymond Addie
(74) *Attorney, Agent, or Firm*—Bacon & Thomas, PLLC

(57) ABSTRACT

A paving machine having a dowel bar insertion assembly and a form piece permit precise placement of at least one dowel bar, in a mass of concrete, before smoothing and leveling of the concrete mass into a desired surface. A detection device activates a drive device to eject the dowel bars into the concrete mass at a desired interval.

8 Claims, 5 Drawing Sheets

METHOD AND MACHINE FOR FORMING A CONCRETE PATH OR THE LIKE, AS WELL AS DEVICE FOR INSERTING DOWELS APPLIED HEREWITH

BACKGROUND

It is known to provide so-called dowels in concrete paths, usually mostly at the location of joints, more particularly so-called load transfer joints, expansion joints or contraction joints. Such dowels are reinforcement bars with a length of approximately 0.5 m, which mostly are provided in the concrete in the longitudinal direction of the path to be formed. Contrary to traditional reinforcement bars, they mostly consist of smooth-surfaced bars used to form a load-transfer joint of expansion or contraction type. Classically, a whole series of such dowels next to each other is provided at mutual interspaces of, for example, 20 to 50 cm. After having provided the dowels in the concrete path and after the concrete possibly already has hardened, over each series of dowels, in the width of the concrete path, up to just above the dowels, a groove is formed, for example, cut, in the concrete, in order to form the expansion joint. With a possible expansion or contraction, the lower part then forms a breaking zone, whereas the dowels still form a connection between both concrete parts, limiting any vertical movement of the concrete, e.g. caused by load applied by the traffic.

According to a known technique, an example of which is known from U.S. Pat. No. 5,405,212, such dowels are provided in the concrete after having formed the concrete path, when the concrete still is wet. To this aim, a series of dowels is dropped in a controlled manner onto the wet concrete surface, after which these dowels subsequently, by means of vibrating forks, are vibrated into the formed concrete path up to a well-defined depth. Usually, this is performed by means of a device situated at the paving machine by which the concrete path is realized, which device, during the insertion of the dowels, temporarily is stopped in respect to the concrete path, whereas the actual paving machine travels on, whereby, after the insertion of the dowels, the respective device is drawn forward.

This known technique has different disadvantages. An important disadvantage consists in that, as the dowels are inserted into the already formed concrete surface, this surface is disturbed, as a result of which an additional finishing operation, mostly by means of a finishing beam also fixed at the paving machine, must be provided for. Even when using such finishing beam, one will note that at the location where the dowels have been inserted, a demixing or so-called segregation of the concrete takes place, resulting in a poor quality of the finally obtained concrete surface.

Another disadvantage of said known technique consists in that such paving machine is relatively long, as a consequence of which it is difficult to turn and difficult to transport, due to the fact that the device must be able to be stopped temporarily for inserting the dowels, whereas the paving machine travels on, and this device, thus, must be movable in the longitudinal direction of the concrete path, over guide elements, as well as due to the fact that an additional finishing beam is required.

Another disadvantage of said known technique consists in that one never knows with certainty whether the dowels are situated on the right place in the concrete, as they may come loose from below the vibrating forks during insertion.

Also, inserting the dowels according to said known technique requires a large power, for commanding and moving the device along the paving machine, as well as for pushing and vibrating the dowels into the concrete.

In order to counteract the demixing of the concrete, it is already known to realize a concrete path in two layers, whereby before providing the second layer, series of dowels are deposited on the first layer. It is, however, obvious that this, due to the fact that a double layer has to be realized, is a complicated technique and/or a technique necessitating the use of rather complicated machines.

SUMMARY

The invention aims at a method and machine with which one or more of said disadvantages can be excluded and according to which a concrete path provided with dowels can be realized in a very efficient manner.

To this aim, according to a first aspect, a method is described for forming a concrete path or the like, which concrete path is provided with dowels, whereby unhardened concrete, by means of at least one form piece moving over the concrete, is brought into the shape of the concrete path to be realized. These dowels are brought into the concrete in front of and/or at the height of the form piece, more particularly before and/or at the moment when the concrete surrounding the dowels is forced, by means of the form piece, into the shape of the concrete path to be realized. In that the dowels in this manner are inserted before the actual concrete surface has been formed, it is excluded that this concrete must be disturbed afterwards. Thus, a demixing of the concrete neither will take place, as a result of which a concrete path with a perfect final quality can be guaranteed.

Of course, in this way there will be no necessity for using a finishing beam, as a consequence of which the construction of the applied machine can be particularly simple. However, this does not exclude that such finishing beam and/or other finishing elements, such as a smoothing board moving to and fro, can be used.

According to one characteristic, the dowels are inserted into the concrete such that, in a longitudinal direction, they are systematically enclosed by the concrete. It follows that the dowels are inserted or injected in a generally horizontal manner in the concrete. Due to this manner of insertion, there is no lateral movement of the dowels through the concrete, which further excludes the occurrence of a certain demixing of the concrete.

According to another characteristic, the concrete is vibrated and the dowels are brought into the concrete at the location where the concrete is vibrated. Thereby, automatically a compacting of the concrete around the dowels is taking place, without any form of demixing occurring.

According to another characteristic, for the insertion of the dowels in the concrete use is made of a device with one or more insertion devices for dowels, and these insertion devices, at least during the periods of time when dowels have to be inserted, are moved, together with the movement of the form piece, through the unhardened concrete which still has to be treated by means of the form piece. In consideration of the fact that the insertion devices substantially are situated in front of the form piece, these elements in fact can be permanently pushed through the rather raw concrete without causing any problem which is contrary to known dowel apparatuses mounted behind the form piece. According to this inventive characteristic, contrary to the known dowel apparatuses, no additional means are necessary for blocking the insertion means in the longitudinal direction of the concrete path and to draw them back to the paving machine after an insertion cycle.

It is clear that in such case, the insertion devices, at least at their lower ends, are located at a distance from each other, thereby providing passages for the concrete between these elements. An important advantage hereby is that the concrete can be poured in front of the insertion devices, and still better in a traditional manner in front of the complete paving machine. This technique is less critical than in the case that the concrete would be supplied in between the insertion devices and the form piece.

In an embodiment of a paving machine, an insertion device is used for inserting the dowels which comprises several feeding elements provided next to each other at regular interspaces, in order to bring thereby several dowels next to each other into the concrete, and the concrete is vibrated by means of different vibrating elements which are positioned between the respective insertion devices.

According to another embodiment, for the insertion of the dowels in the concrete, at least one insertion device is provided and dowels are pushed out of this insertion device in a longitudinal direction and thereby inserted into the concrete. As a consequence thereof, the dowels are put into the concrete in a particularly uniform manner.

In a practical view, the dowels are inserted by keeping them ready in the insertion devices, in the longitudinal direction of the concrete path, and subsequently, at the moment when they have to be brought into the concrete, releasing them from the insertion devices according to their longitudinal direction. As this takes place according to the longitudinal direction, the surrounding concrete is not disturbed and the risk of demixing is minimized.

Preferably, the dowels are kept ready in a guide tube or centering part and/or sealing part, from where the dowels, through an exit opening, are brought outside one after the other. This centering part and/or sealing part preferably is oblong and slim, such that it is easily enclosed by the concrete and subsequently this concrete connects around the released dowels in an efficient manner.

More particularly, it is preferred that the dowels are expelled by means of a centering part and/or sealing part; that at a location where a dowel has to be inserted, such dowel is kept ready in the centering part and/or sealing part; that a second dowel is provided behind said dowel, in the prolongation thereof; and that during inserting, the first dowel is pushed outside by the movement of the second, after which the second dowel becomes located in the centering part and/or sealing part, ready for a subsequent cycle. This technique offers the advantages that the dowels simply can be brought from the insertion devices to the outside, as well as that no concrete can penetrate into the insertion device, as the place of each inserted dowel immediately is taken by another.

According to another embodiment, the dowels are released from the insertion devices by moving them in a direction of movement in respect to the insertion devices moved through the concrete which is opposed to the direction of movement of the insertion devices, however, with a speed which is equal to, or approximately equal to, the speed of the insertion devices traveling through the concrete. Hereby, it is achieved that the dowels during inserting are standing still in respect to the ambient concrete and that the concrete sets around them. This also contributes to preventing any form of demixing of the concrete.

It is noted that the characteristic, according to which the dowels are inserted at the location where the concrete is vibrated, as well as the characteristic according to which the dowels are inserted such into the concrete that they systematically are surrounded by the concrete in a longitudinal direction, form characteristics which minimize the risk of demixing of the concrete. In addition, they also may be applied apart from the fact whether the dowels are inserted into the concrete at a location in front of the form piece and/or at the height of the form piece.

According to another aspect, a method for forming a concrete path or the like is provided, which concrete path is provided with dowels, wherein unhardened concrete, by means of at least one form piece moving over the concrete, is brought into the shape of the concrete path to be realized, with as a characteristic that the concrete is vibrated and that the dowels are inserted into the concrete at the location where the concrete is vibrated. As the dowels are inserted at the location where the concrete is vibrated, in fact a compacting of the concrete around the dowels is created, without having a demixing occurring, regardless whether the insertion now takes places in front, below or behind the form piece.

According to yet another aspect, a method for forming a concrete path or the like is provided, which concrete path is provided with dowels, wherein unhardened concrete, by means of at least one form piece moving over the concrete, is brought into the shape of the concrete path to be realized, with as a characteristic that the dowels are inserted such into the concrete that, in longitudinal direction, they are systematically surrounded by the concrete.

It is clear that these inventive characteristics can be combined at random, whereby it is obvious that certain combinations may offer additional advantages.

Further, according to another embodiment, a paving machine for forming a concrete path according to the methods described heretofore is provided. Such machine at least comprises a movable frame, to which a form piece for forming the concrete path is attached, as well as a device for inserting dowels, and, has the characteristic that the device for inserting dowels is situated, according to the travel direction of the machine, in front of and/or at the height of the form piece.

It is clear that the invention also relates to an insertion device for inserting dowels which allows to realize the method, as well as a paving machine according to the invention. Of course, such devices may be constructed as units for separate attachment at a paving machine.

It is noted that such device, regardless of the fact whether it fixedly belongs to a certain paving machine or not, can be made modular, as a consequence of which it may easily be adapted to different working widths and/or the interspaces between the dowels situated next to each other may easily be adapted. It is also not excluded to realize the device telescopically adjustable according to the working width, for example, by applying a series of insertion units which are suspended at a telescopic frame and which, in function of the span of the telescopic frame, all systematically are suspended farther or less far from each other, whereby possibly certain units, when suspended too close to each other, can be taken out of operation.

BRIEF DESCRIPTION OF THE DRAWINGS

With the intention of better showing the characteristics according to the invention, hereafter, as an example without any limitative character, a preferred form of embodiment is described, with reference to the accompanying drawings, wherein.

DESCRIPTION OF PREFERRED EMBODIMENTS

Figure 1:
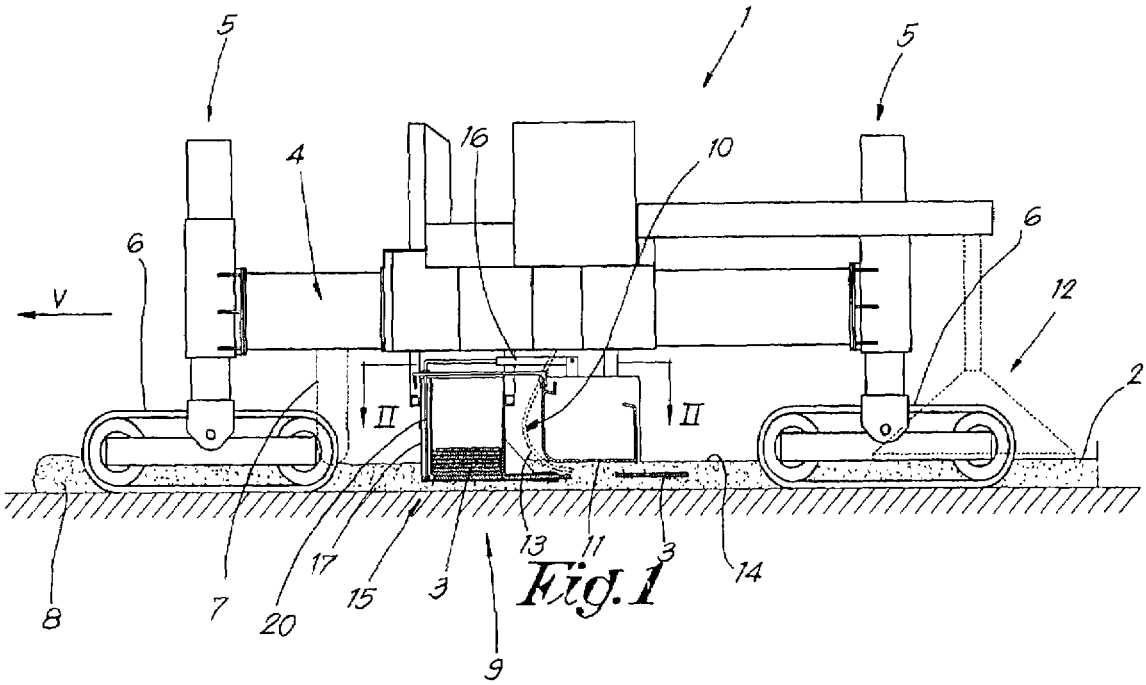
FIG. 1 schematically, in side view and partially in cross-section, represents a paving machine according to the invention.

As represented in FIG. 1, a machine, more particularly a paving machine 1, for forming a concrete path 2 is provided with dowels 3.

The paving machine 1 comprises a frame 4, whether or not extensible in width and/or length, and which is movable by means of support elements 5 situated, for example, at the corner points, which elements are provided, for example, with crawler tracks 6 which can be driven by means of motors which are not represented in the figures.

At the frame 4 and/or at the support elements 5, different tools are attached for realizing the concrete path 2. Depending on the application, either several tools are applied or not. In the example of FIG. 1, these tools consist of, respectively, schematically indicated concrete spreader 7 for spreading concrete 8 poured in front of the paving machine 1, a apparatus 9 for inserting the dowels 3, means 10 for vibrating the concrete, one or more form pieces 11 and a finishing element 12.

The concrete spreader 7 may be of different kind and consist, for example, of a plough for spreading the concrete 8 and/or a driven element, such as a worm screw for distributing the concrete 8.

Figure 2:
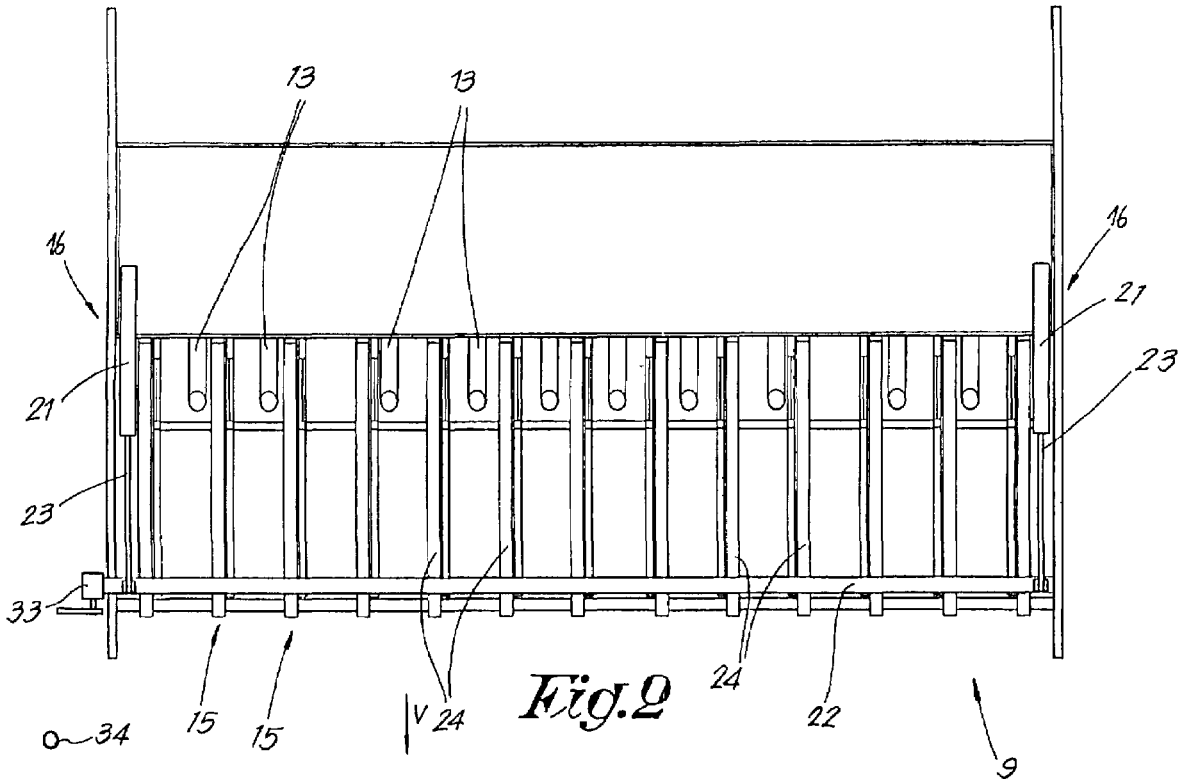
FIG. 2 schematically represents a cross-section according to line II—II in FIG. 1.

As represented in FIGS. 1 and 2, the means 10 for vibrating the concrete preferably consist of a series of internal vibrators in the shape of a needle, further called vibrating elements 13, which, during the treatment of the concrete 8, reach up into the concrete 8, preferably up to below the form piece 11. Such vibrating elements 13 may consist in a known manner of cylindrical elements in which driven excenter weights are provided, the speed of which preferably can be regulated.

The form piece 11 substantially consists of a large mould with which the concrete is pressed into a certain shape and simultaneously is given a smooth surface. When producing a classical concrete path, the form piece is made in a straight manner, for example, as a profile with a cross-section, such as represented in FIG. 1, which extends over the working width. It is clear that it may also have special shapes and may be composed of several parts, for example, for forming a gutter, a standing edge or the like at a concrete path.

The form piece 11 defines a leading edge 36, a forming surface 38 extending towards a trailing end of the frame 4, and a transition point 40 whereat the leading edge 36 merges with the forming surface 38.

Also, several of such form pieces may be applied which can be displaced along each other, such that the working width can be adapted. When in the following, a form piece is mentioned, it is clear that this is also valid for embodiments where several such form pieces are present.

In FIG. 1, the finishing element 12 comprises a smoothing board which can be moved systematically over the formed surface 14 of the concrete path 2.

Of course, the concrete spreader 7 and the finishing element 12 are optional.

According to one embodiment of the paving machine, apparatus 9 for inserting dowels 3, according to the travel direction V of the paving machine 1 during paving, is situated in front of and/or at the height of the form piece 11, contrary to known embodiments whereby the dowel apparatus is mounted behind the form piece.

Such as clearly visible in FIG. 2, the apparatus 9 substantially is composed of, on one hand, a series of insertion devices 15 for inserting dowels 3, positioned adjacent to each other at regular interspaces, and, on the other hand, a drive device 16 cooperating therewith.

The insertion devices 15 are suspended such at the frame 4 that they, during the operation of the machine 1, anyway, at least during the periods of time when dowels 3 have to be brought into the concrete 8, reach up into the concrete 8 situated in front of the form piece 11, more particularly are hanging down into the concrete with their undersides.

The insertion devices 15 and the vibrating elements 13 are positioned in an alternating manner adjacent to each other, distributed over the working width, as clearly represented in FIG. 2.

As represented in FIGS. 3 to 8, the insertion devices 15 comprise upwardly directed elements, each with a housing 17 of a small width extending substantially in a vertical plane parallel to the travel direction of the machine 1. Each housing defines upper and lower portions.

These insertion devices 15 each comprise two compartments situated adjacent to each other, on one hand, a first compartment 18 functioning as a magazine and in which dowels 3 can be stacked horizontally one upon the other and, on the other hand, a second compartment 19 forming a passage for a pressing mechanism pertaining to the drive device 16, more particularly a ejection device 20, which ejection device 20 in fact can be considered as a device for horizontal injection of the dowels.

The ejection devices 20 of the respective insertion devices 15, which, in the represented example, comprise vertical rods, are coupled at their upper side to drive elements pertaining to the drive device 16, according to one embodiment, two simultaneously movable pressure cylinders 21, in such a manner that all ejection devices 20 simultaneously can be subjected to a to-and-fro movement S. To this aim, the ejection devices 20 are connected at their upper portion to a transverse profile 22 extending according to the working width of the machine 1, which profile, in its turn, is movable in that it is coupled, as represented in FIGS. 2 to 7, to the piston rods 23, which can be moved in and out, of the pressure cylinders 21. Hereby, the transverse profile 22 can be shifted over guides 24.

At their lower portion, the ejection devices 20 are provided with a laterally directed cam 25, as a result of which they can cooperate, by means of an open connection, more particularly a passage 26, between the two compartments 18–19, with a dowel 3 situated below in the first compartment 18.

It is obvious that instead of two pressure cylinders 21, also other drive devices may be applied, whether or not they are common to the respective insertion devices 15.

To the lower portion of the rear wall 28 of each compartment 18, next to the bottom thereof, a guide tube 28 is connected which consists of a relatively slim element, with a through-channel 29 which, on one hand, gives out in the magazine for the dowels 3 and, on the other hand, at its free portion, forms an outlet opening 30 for the dowels 3. This guide tube 28 extends parallel to the movement direction of the paving machine 1 and usually is situated such that the outlet opening 20, viewed according to the thickness of the concrete path 2 to be realized, is situated approximately in the middle thereof, as well as it is situated below the front half of the form piece 11, and still more particularly, at the height of the extremities of the vibrating elements 13.

Figure 9:
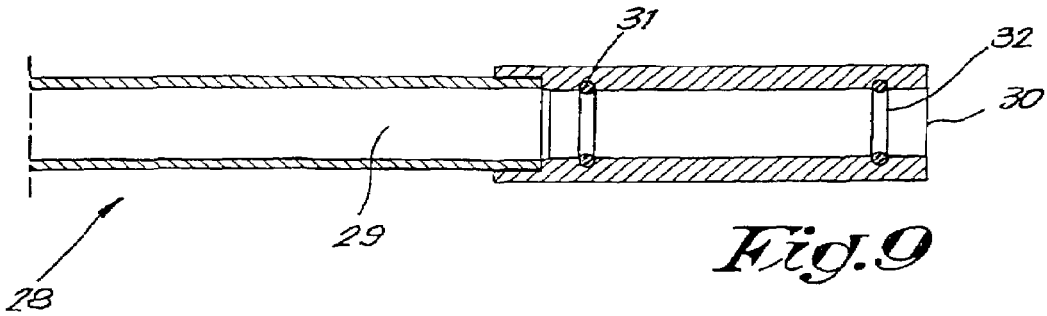
FIG. 9, at a larger scale, represents the part indicated by arrow F9 in FIG. 4.

As represented in greater detail in FIG. 9, the guide tube 28 preferably consists of an exchangeable sleeve in which two support points for the centered holding of the dowels 3, in the form of sealing rings 31–32, are provided. Due to the exchangeability, it is possible to provide sleeves for dowels 3 of different diameters and/or lengths.

The guide tube 28 preferably extends with such a length behind the rear wall 27 that, during the presence of one dowel 3 in this part 28, still a second dowel 3 from of compartment 18 can be positioned therebehind.

Further, the apparatus 9 is equipped with a detection device 33 which can cooperate with guide elements 34, erected next to the paving path, for example, small posts provided especially to this aim, and thereby it can activate the drive device 16.

The functioning of the paving machine 1, and more particularly of the apparatus 9, can easily be deduced from the figures and substantially is such as explained hereafter.

Figure 3:
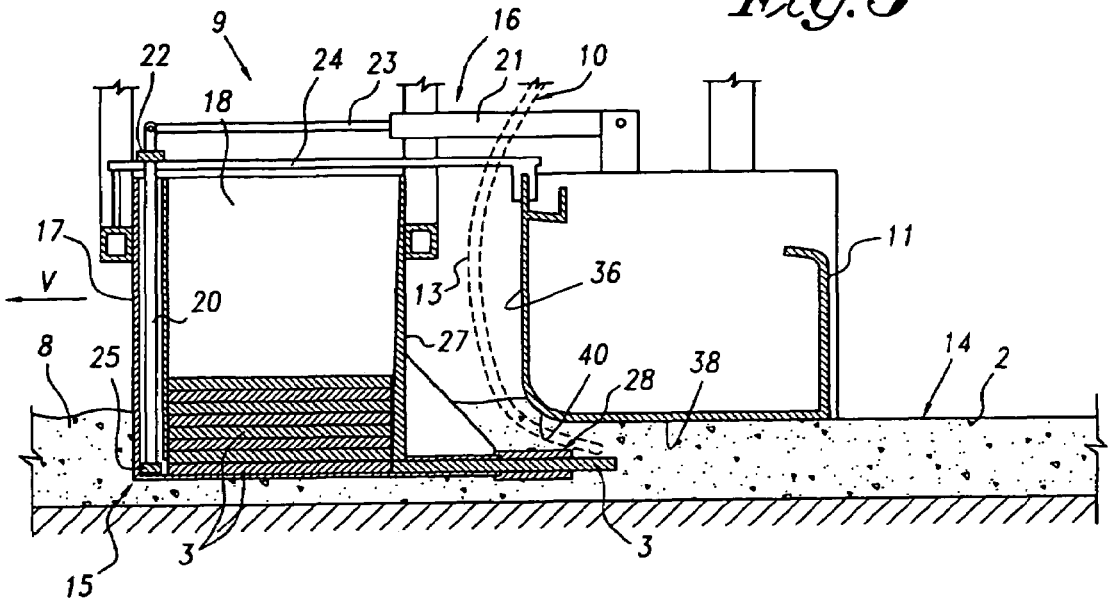
FIGS. 3 to 6, at a larger scale and for different positions, represent the part indicated by arrow F3 in FIG. 1.

First, a sufficient number of dowels 3 is provided in the compartments 18. In rest position, each ejection device 20 is situated with its cam 25 behind the lowermost dowel 3 present in the pertaining magazine. Initially, the pressing elements 20 then are moved once to and fro, by having the piston rods 23 once go in and back out. As a result thereof, a condition ready for an operation cycle is created, as illustrated in FIG. 3, whereby at the bottom, two dowels 3 are situated axially one behind the other, one of which is situated in the guide tube 21, in readiness for being applied.

When forming the concrete path 2, concrete 8 is poured in front of the paving machine 1. This concrete 8 first is roughly spread by said concrete spreader 7, after which, by means of the form piece 11, the actual concrete path 2 is formed. An additional smoothing movement may be performed by means of the finishing element 12.

At the moment when the concrete gets under the form piece 11, it is vibrated by means of the vibrating elements 13, as a result of which is compacted and homogenized.

During paving, the insertion devices 15 are sliding through the concrete 8.

When a series of dowels 3 has to be inserted, this is taking place in the manner as depicted systematically in FIGS. 3 to 6.

To this aim, the pressing elements 20, which originally are in the starting position of FIG. 3, are subjected to a backward displacement S by having the piston rods 23 go in. The activation of the piston rods 23 hereby is, for example, the consequence of a signal delivered by said detection device 33. Of course, such activation also can be commanded manually by applying an appropriate control signal to the pressure cylinders 21.

Figure 4:
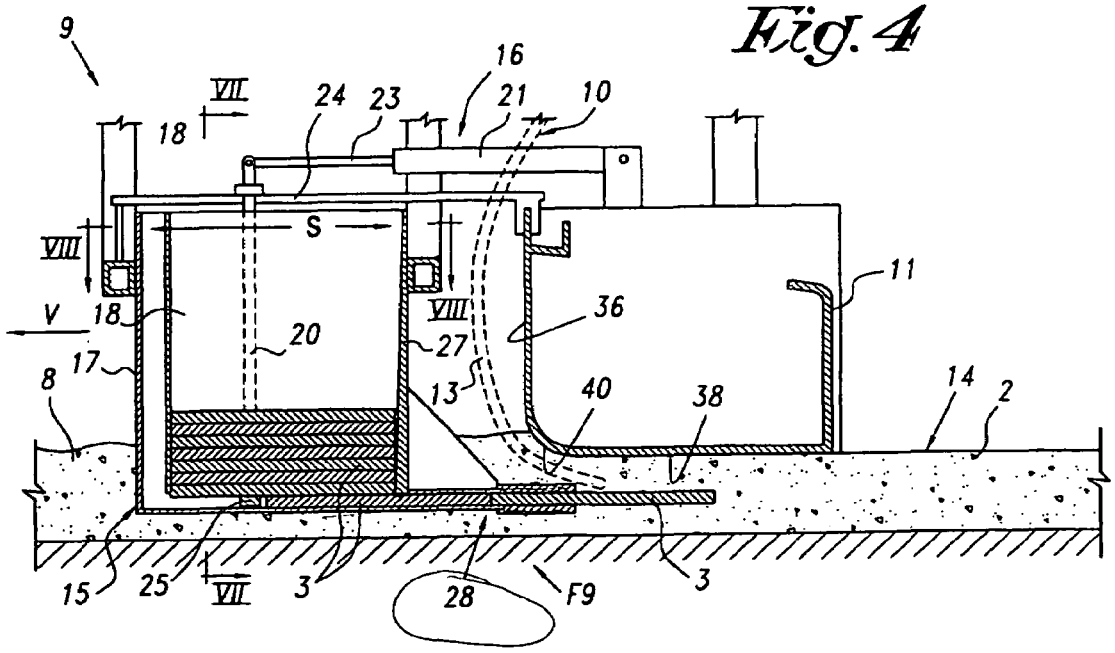

Due to the displacement of the pressing elements 20, first of all a condition is created as in FIG. 4, whereby the lowermost dowel 3 is pushed from the magazine into the guide tube 28, whereas the dowel 3 previously present therein is pushed outward.

The drawing in of the piston rod 23, and more particularly the displacement of the ejection devices 20, is performed at a speed which is equal to the traveling speed of the paving machine 1. On account of the fact that the direction of displacement of the ejection devices 20 in respect to the insertion devices 15, however, is opposed to the travel direction of the paving machine 1, this results in the fact that the dowels 3 which leave the insertion devices 15 are kept at a standstill in respect to the surroundings, whereas the insertion devices 15 move forward and thereby release the respective dowels 3. This speed can be regulated by means of appropriate, not-represented control means.

As a consequence, the dowels 3, being released and inserted into the concrete 8, are, according to their longitudinal direction, systematically surrounded by the concrete, whereby, also as a result of the effect of the vibrating elements 13, a good compacting of the concrete 8 around the dowels 3 is obtained.

Figure 5:
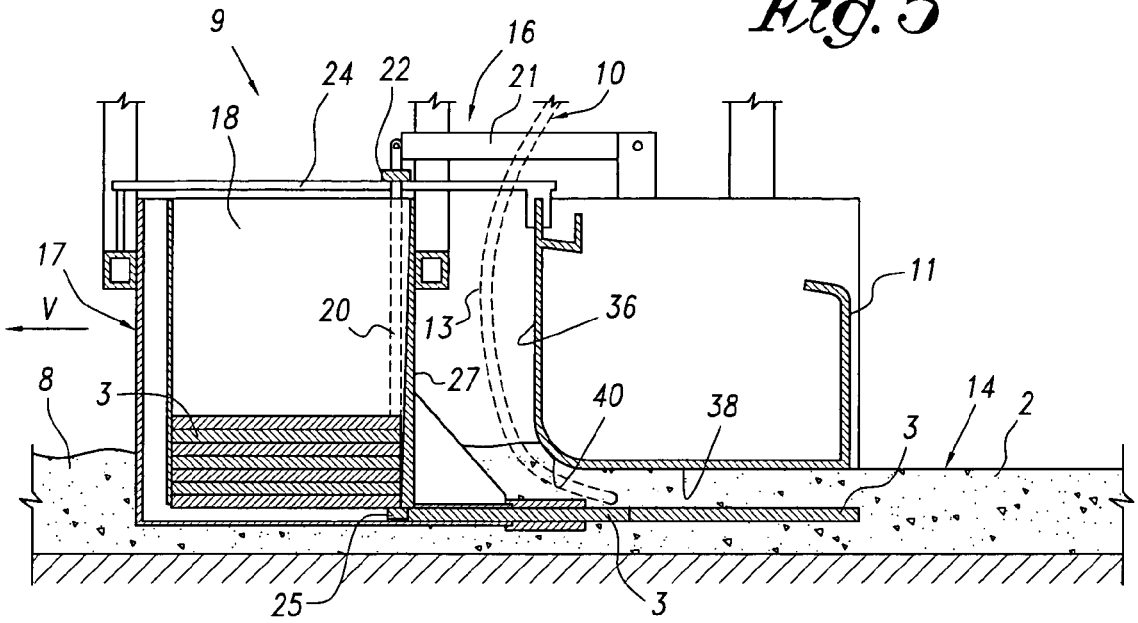
Figure 6:
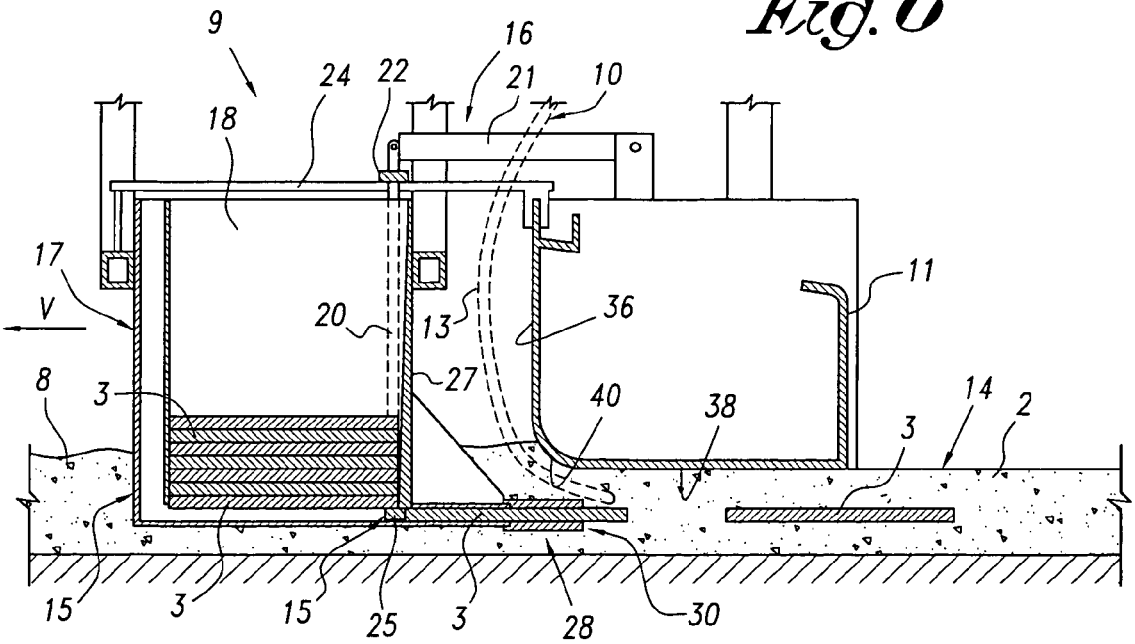
Figure 7:
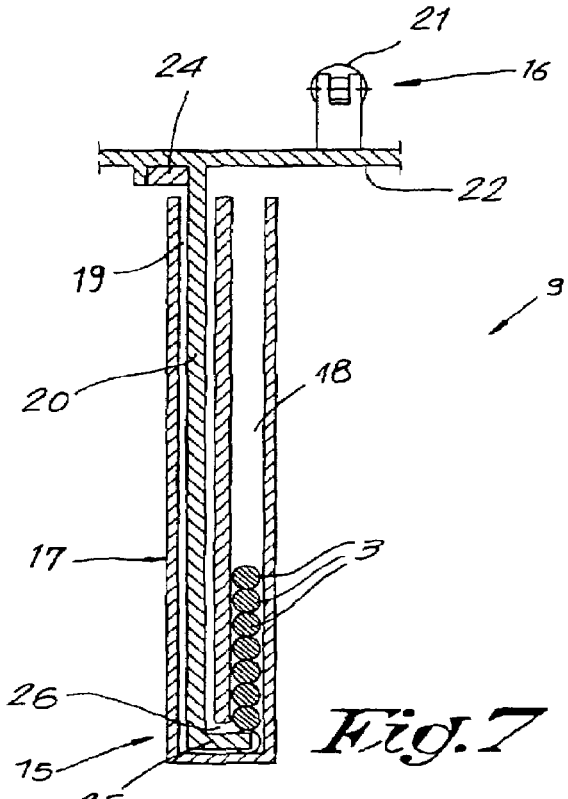
FIGS. 7 and 8 represent cross-sections according to lines VII—VII and VIII—VIII, respectively, in FIG. 4.
Figure 8:
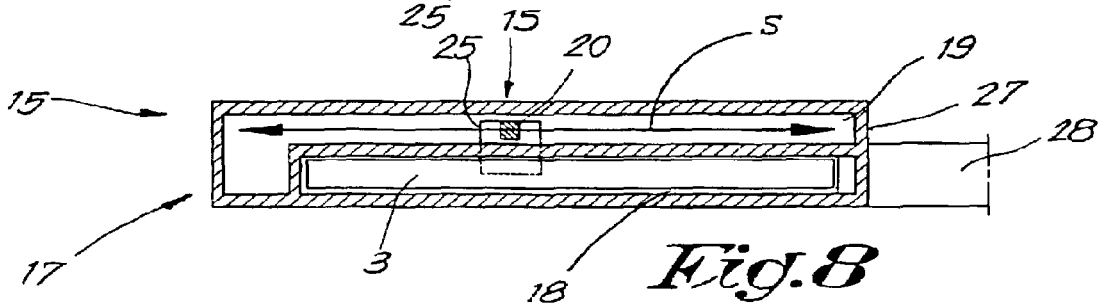

Finally, a condition is created, as depicted in FIG. 5, whereby said second dowel 3 each time becomes located in the guide tube 28, whereas the first dowel 3 is sitting freely in the concrete 8. In consideration of the fact that the paving machine 1 is traveling on, the first dowel, as depicted in FIG. 6, remains in the concrete path 2, whereas the second dowel is carried along in the guide tube 28.

By moving the ejection devices 20 back, again a starting condition, as represented in FIG. 3, is created.

The functioning explained heretofore also illustrates the method described in the introduction.

Of course, different variants are possible. The main idea of the invention consists in that the dowels 3 are brought into the concrete 8 in front of or at the height of the form piece 11, and it is clear that according to the invention, this may be realized in any other manner than described in the aforegoing.

So, for example, this must not necessarily be realized by means of insertion devices 15 which are equipped with magazines for several dowels 3.

It is also possible to provide an automatic supply system for dowels, more particularly for filling the magazines, above the insertion devices 15.

Also, different parts may be made adjustable, exchangeable and/or modular. So, for example, is it possible to apply adaptable side walls in the compartments 18, as a result of which the length and diameter of the compartments 18 can be adjusted in function of the length of the applied dowels 3. Also the depth at which the insertion devices 15 are hanging in the concrete 8, as well as the location where these insertion devices 15 are attached in the width of machine 1, can be adjustable.

Although the dowels preferably are inserted parallel to the travel direction of the paving machine, it is not excluded to realize this at a slight angle of, for example, 15 degrees. To this end, the insertion devices 15 can be adjusted at an angle.

Due to the fact that the insertion devices 15 are pushed through the concrete, the magazines can be located quite close to the form piece, which offers several advantages, such as a more stable construction. In a preferred embodiment, this distance is less than the maximum length of the dowel bars for which the magazines have been designed.

The present invention is in no way limited to the forms of embodiment described by way of example and represented in the figures, on the contrary may such method and machine for forming a concrete path or the like, as well as the device for inserting the dowels used therewith, be realized according to various variants without leaving the scope of the invention.

The invention claimed is:

1. A paving machine system, comprising:

a paving machine including a frame defining a longitudinal axis extending between forward and rearward ends;

a form piece connected to the frame and extending a first downward distance from the frame, the form piece having a leading edge, a forming surface extending towards the trailing end of the frame, and a transition point whereat the leading edge merges with the forming surface;

at least one insertion device connected to the frame and spaced a distance from the form piece towards the forward end of the frame, the at least one insertion device including a housing arranged to contain a plurality of dowels and defining upper and lower portions, a guide tube extending generally parallel to the longitudinal axis of the frame from the lower end portion of the housing to a position before or at the transition point of the form piece, and an ejection device positioned in the housing and cooperating with the guide tube to individually eject dowels stored by the housing through the guide tube such that the lower end of the housing extends from the frame a second downward distance greater than the first downward distance from the form piece;

a drive device connected to the frame and arranged to control the at least one insertion device to eject dowels through the guide tube;

a detection device connected to the paving machine and configured to activate the drive device; and a plurality of guide elements arranged for positioning along a concrete path;

wherein the detection device is configured to detect the guide elements and activate the drive device upon detection of the guide elements so as to cause the insertion device to eject at least one dowel through the guide tube.

2. The paving machine according to claim 1, wherein the second downward distance extends at a distance at which the guide tube protruding from the at least one insertion device is surrounded by wet concrete as the paving machine forms a concrete path with wet concrete.

3. The paving machine according to claim 1, wherein the second downward distance extends at a distance at which the lower portion of the housing of the at least one insertion device is configured is surrounded by wet concrete when the paving machine forms a concrete path with wet concrete.

4. The paving machine according to claim 3, further comprising at least one vibrating element connected to the frame and positioned adjacent the at least one insertion device such that the at least one vibrating element and the at least one insertion device are positioned adjacent one another in an alternating sequence over a working width of the frame.

5. The paving machine according to claim 1, wherein the at least one insertion device defines a space adjacent the guide tube so as to permit insertion of first and second dowels in the guide tube along a common axis.

6. The paving machine according to claim 1, further comprising a control device configured to regulate the speed of the drive device such that dowels are fed from the housing into the guide tube and ejected therefrom at a predetermined rate.

7. The paving machine according to claim 1, wherein the housing defines a magazine for holding a plurality of dowels wherein a lowermost dowel in the magazine is in register with the guide tube and the ejection device.

8. The paving machine according to claim 7, wherein the housing of the at least one insertion device defines separate compartments for the magazine and the ejection device, the ejection device extending between the upper and lower portions of the housing whereat the upper portion the ejection device is in communication with a drive device connected to the frame and arranged for driving the ejection device, and the lower portion of the ejection device is in communication with the magazine and the lowermost dowel contained therein.

* * * * *